US010486441B2

(12) United States Patent
Masuda et al.

(10) Patent No.: US 10,486,441 B2
(45) Date of Patent: Nov. 26, 2019

(54) PRINTING APPARATUS, INSPECTION APPARATUS, AND METHOD OF CONTROLLING THE INSPECTION APPARATUS IN WHICH A FIXING UNIT FIXES A RELATIVE POSITION BETWEEN A DETECTION SURFACE OF A READING UNIT AND A PRINT MEDIUM

(71) Applicant: CANON KABUSHIKI KAISHA, Tokyo (JP)

(72) Inventors: Mika Masuda, Kawasaki (JP); Shinya Asano, Tokyo (JP); Takashi Horiba, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/891,848

(22) Filed: Feb. 8, 2018

(65) Prior Publication Data

US 2018/0229518 A1 Aug. 16, 2018

(30) Foreign Application Priority Data

Feb. 16, 2017 (JP) ..... 2017-027273

(51) Int. Cl.
*B41J 2/21* (2006.01)
*B41J 2/165* (2006.01)
(Continued)

(52) U.S. Cl.
CPC ..... *B41J 11/0095* (2013.01); *B41F 7/02* (2013.01); *B41F 31/08* (2013.01); *B41F 31/28* (2013.01); *B41F 33/0036* (2013.01); *B41J 2/01* (2013.01); *B41J 2/16517* (2013.01); *B41J 2/16588* (2013.01); *B41J 2/21* (2013.01); *B41J 11/0015* (2013.01); *B41J 13/0036* (2013.01); *B65H 29/041* (2013.01); *B65H 43/04* (2013.01); *B41J 2002/012* (2013.01); *B41J 2025/008* (2013.01); *B65H 2301/4493* (2013.01);
(Continued)

(58) Field of Classification Search
CPC ... B41J 2/01; B41J 2/21; B41J 2/16517; B41J 2/16588; B41J 11/0095; B41J 11/0015; B41F 31/08; B41F 31/28; B41F 33/0036
See application file for complete search history.

(56) References Cited

U.S. PATENT DOCUMENTS

2003/0194252 A1* 10/2003 Nakamori ..... B41J 11/009 399/389

FOREIGN PATENT DOCUMENTS

JP 2013-228640 A 11/2013

* cited by examiner

*Primary Examiner* — Jason S Uhlenhake
(74) *Attorney, Agent, or Firm* — Venable LLP

(57) ABSTRACT

A printing apparatus includes a reading unit, having a detection surface, that reads an image on a print medium, and a fixing unit that fixes a relative position between the detection surface and the print medium in one of a first state, in which the detection surface is in contact with the print medium, and a second state, in which the detection surface is not in contact with the print medium. A control unit stops conveyance and fixes the relative position between the detection surface and the print medium to the first state, using the fixing unit, in a case in which the reading unit reads the image, and changes the relative position between the detection surface and the print medium from the first state to the second state, using the fixing unit, and resumes conveyance after image reading by the reading unit is complete.

20 Claims, 12 Drawing Sheets

(51) Int. Cl.

| | |
|---|---|
| ***B41J 11/00*** | (2006.01) |
| ***B41F 31/08*** | (2006.01) |
| ***B65H 29/04*** | (2006.01) |
| ***B41J 13/00*** | (2006.01) |
| ***B41J 2/01*** | (2006.01) |
| ***B65H 43/04*** | (2006.01) |
| ***B41F 31/28*** | (2006.01) |
| ***B41F 33/00*** | (2006.01) |
| ***B41F 7/02*** | (2006.01) |
| *B41J 25/00* | (2006.01) |

(52) U.S. Cl.

CPC .. *B65H 2301/542* (2013.01); *B65H 2301/544* (2013.01); *B65H 2405/55* (2013.01); *B65H 2601/25* (2013.01); *B65H 2801/03* (2013.01); *B65H 2801/15* (2013.01); *B65H 2801/21* (2013.01)

PRINTING APPARATUS, INSPECTION APPARATUS, AND METHOD OF CONTROLLING THE INSPECTION APPARATUS IN WHICH A FIXING UNIT FIXES A RELATIVE POSITION BETWEEN A DETECTION SURFACE OF A READING UNIT AND A PRINT MEDIUM

This application claims the benefit of Japanese Patent Application No. 2017-027273, filed on Feb. 16, 2017, which is hereby incorporated by reference herein in its entirety.

BACKGROUND OF THE INVENTION

Field of the Invention

The present invention relates to a printing apparatus, an inspection apparatus, and a method of controlling the inspection apparatus, and, particularly to, for example, a printing apparatus, an inspection apparatus, and a method of controlling the inspection apparatus that inspect the quality of an image on a print medium to which an image formed by discharging ink to a transfer member is transferred.

Description of the Related Art

Conventionally, some image forming apparatuses, each forming an image on a print medium, are configured to first form an image on, for example, an intermediate transfer member, such as an intermediate drum, and to transfer the image to the print medium, thereby printing the image. In the apparatus thus configured, various processes are performed in order to improve the quality of the formed image.

For example, an image forming apparatus disclosed in Japanese Patent Laid-Open No. 2013-228640 is configured to convey a sheet while performing detection (rapid reading) of an image density by bringing a backup roller into contact with the sheet when reading a density patch formed on a print medium, such as a sheet. Then, the detection result is fed back to the image forming processing. In this operation of detecting the image density, the sheet is pressed against the detection surface, stabilizing a sheet movement.

In the prior art, however, the backup roller is brought into line contact in a direction perpendicular to a sheet conveyance direction because rapid reading is performed, and the sheet remains unstable owing to an uneven nip-pressure of the roller, an axial shift with respect to the sheet conveyance direction, or the like. It is, therefore, impossible to detect the image density with sufficient accuracy. In addition, the surface of the sheet may be scratched because the sheet is conveyed while pressing the backup roller against the detection surface of the image density of the sheet as a result of image formation.

SUMMARY OF THE INVENTION

Accordingly, the present invention is conceived as a response to the above-described disadvantages of the conventional art.

For example, a printing apparatus, an inspection apparatus, and a method of controlling the inspection apparatus according to this invention are capable of inspecting the image of a printed product accurately without scratching a print medium as the printed product.

According to one aspect, the present invention provides a printing apparatus comprising a printhead configured to discharge ink to a transfer member to form an image, a transfer unit configured to transfer the image from the transfer member to a print medium, a conveyance unit configured to convey the print medium, a reading unit configured to read the image on the print medium conveyed by the conveyance unit, a fixing unit configured to fix the print medium to a reading area by the reading unit, and a control unit configured to control so as to stop conveyance by the conveyance unit and to fix the print medium by the fixing unit in a case in which the reading unit reads the image, and to release fixing of the print medium by the fixing unit and to resume conveyance by the conveyance unit in a case in which image reading by the reading unit is complete.

According to another aspect, the present invention provides an inspection apparatus that reads an image printed on a print medium and inspects the image, the apparatus comprising a conveyance unit configured to convey the print medium, a reading unit configured to read the image on the print medium conveyed by the conveyance unit, a fixing unit configured to fix the print medium to a reading area by the reading unit, and a control unit configured to control so as to stop conveyance by the conveyance unit and to fix the print medium by the fixing unit in a case in which the reading unit reads the image, and to release fixing of the print medium by the fixing unit and to resume conveyance by the conveyance unit in a case in which image reading by the reading unit is complete.

According to still another aspect, the present invention provides a method of controlling an inspection apparatus that reads an image printed on a print medium and inspects the image, the method comprising reading, by a reading unit, the image on the print medium conveyed by a conveyance unit, fixing, by a fixing unit, the print medium to a reading area by the reading unit, and controlling so as to stop conveyance by the conveyance unit and to fix the print medium by the fixing unit in a case in which the reading unit reads the image, and to release fixing of the print medium by the fixing unit and to resume conveyance by the conveyance unit in a case in which image reading by the reading unit is complete.

The invention is particularly advantageous since it is possible to read and to inspect the image accurately without scratching the print medium.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings.

Description of Terms

In this specification, the terms "print" and "printing" not only include the formation of significant information, such as characters and graphics, but also broadly include the formation of images, figures, patterns, and the like, on a print medium, or the processing of the medium, regardless of whether they are significant or insignificant, and regardless of whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereafter) should be broadly interpreted to be similar to the definition of "print" described above. That is, "ink" includes a liquid that, when applied onto a print medium, can form images, figures, patterns, and the like, can process the print medium, and can process ink. The process of ink includes, for example, solidifying or insolubilizing a coloring agent contained in ink applied to the print medium.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like, are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process, or the like.

Printing System

Figure 1:
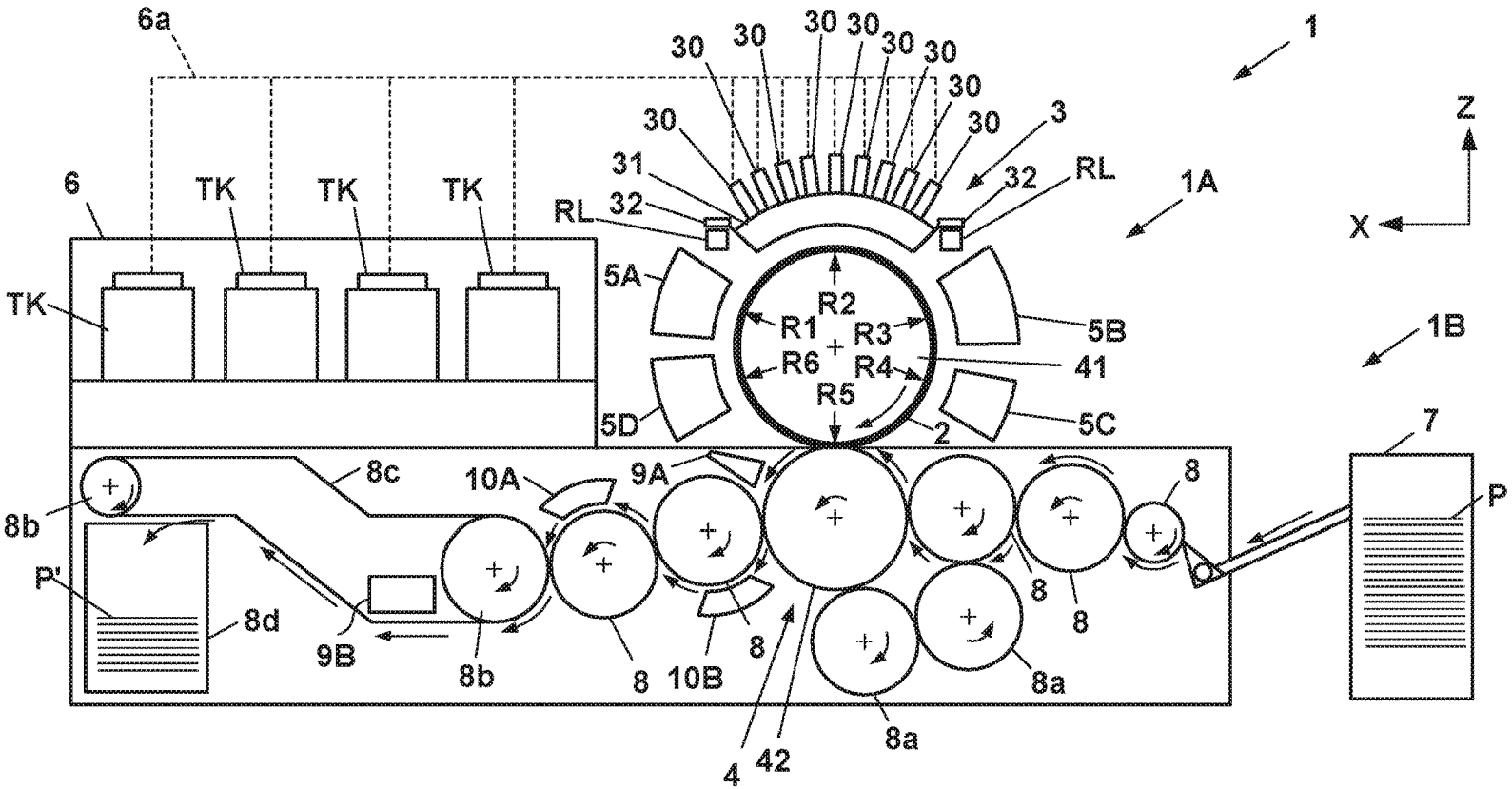
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), a depth direction, and a height direction of the printing system 1, respectively. The print medium P is conveyed in the X direction.

Printing Apparatus

The printing apparatus 1A includes a print unit 3, a transfer unit 4, peripheral units 5A to 5D, and a supply unit 6.

Print Unit

Figure 2:
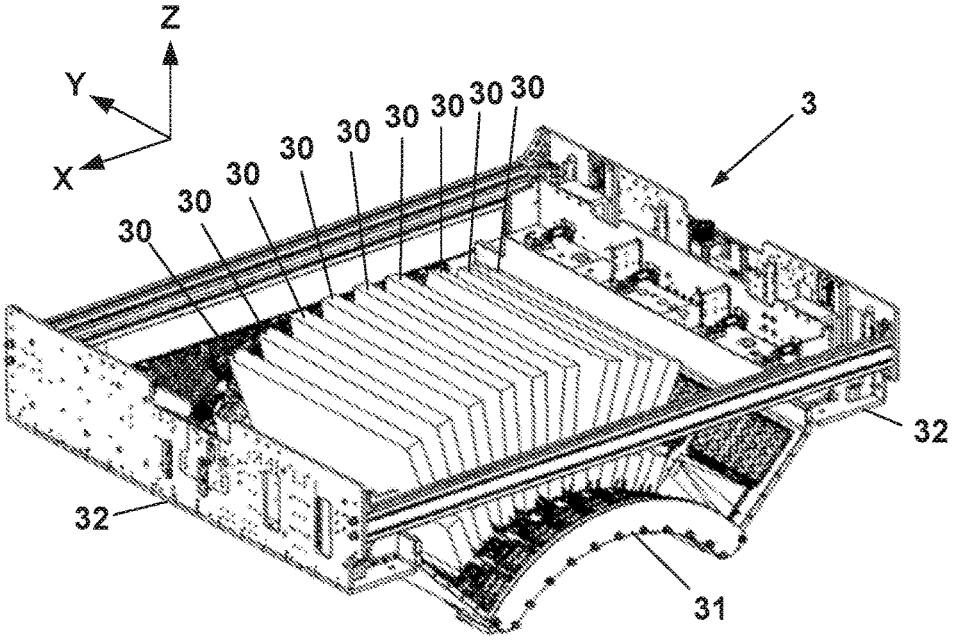
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range in which they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus, the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like, can be used as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. One printhead 30 may be configured, however, to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and are provided as a pair separately in the X direction. A slide portion 32 is provided on each side of the carriage 31 in the X direction. The slide portions 32 engage with the guide members RL and slide along the guide members RL in the Y direction.

Figure 3:
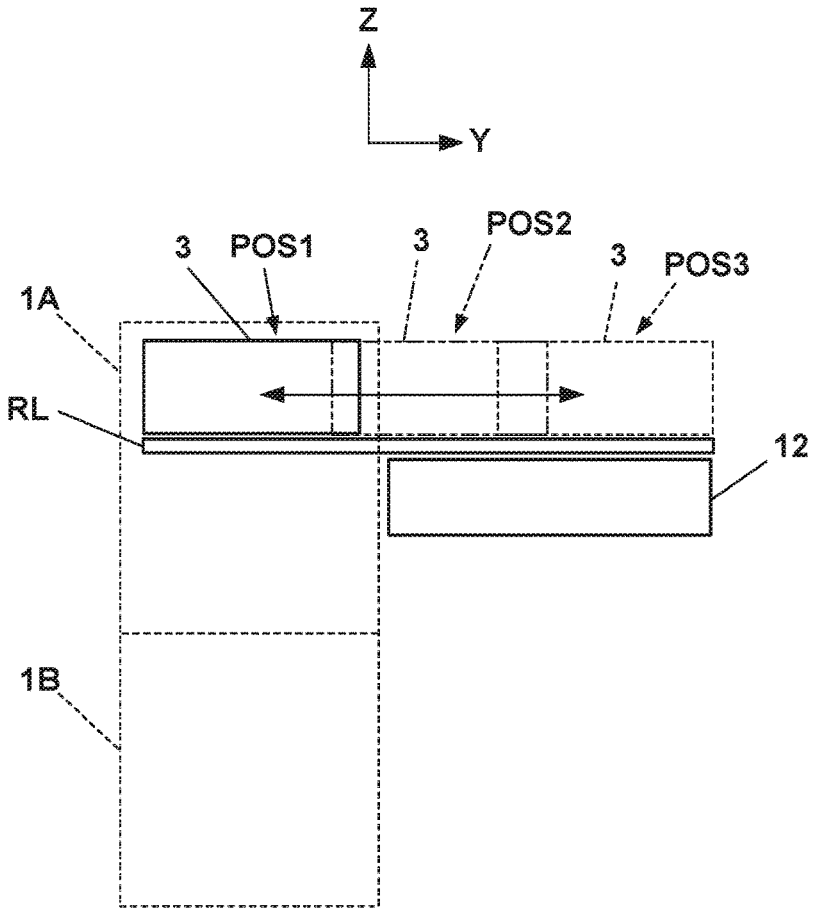
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism that caps the ink discharge surface of each printhead 30, a wiper mechanism that wipes the ink discharge surface, and a suction mechanism that sucks ink in the printhead 30 by a negative pressure from the ink discharge surface can be used as the mechanism for recovering discharge performance of the printheads 30.

The guide member RL is elongated over the recovery unit 12 from the side of the transfer member 2. By the guide of the guide member RL, the print unit 3 is displaceable between a discharge position POS1, at which the print unit 3 is indicated by a solid line, and a recovery position POS3, at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

Transfer Unit

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates counterclockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends divided into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area in which preprocessing is performed on the transfer member 2 before the print unit 3 discharges ink and an area in which the peripheral unit 5A performs processing. In this embodiment, a reactive liquid is applied. The discharge area R2 is a formation area in which the print unit 3 forms an ink image by discharging ink to the transfer member 2. The processing areas R3 and R4 after discharge are processing areas in which processing is performed on the ink image after ink discharge. The processing area R3 after discharge is an area in which the peripheral unit 5B performs processing, and the processing area R4 after discharge is an area in which the peripheral unit 5C performs processing. The transfer area R5 is an area in which the transfer unit 4 transfers the ink image on the transfer member 2 to the print medium P. The processing area R6 after transfer is an area in which post processing is performed on the transfer member 2 after transfer and an area in which the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer, but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface on which the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic, can be used appropriately. With respect to durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of surface treatments may be combined. It is also possible to provide any desired surface shape in the surface layer.

For example, acrylonitrile-butadiene rubber, acrylic rubber, chloroprene rubber, urethane rubber, silicone rubber, or the like, can be used as a material for the compressed layer. When such a rubber material is formed, a porous rubber material may be formed by blending a predetermined amount of a vulcanizing agent, a vulcanizing accelerator, or the like, and further blending a foaming agent, or a filling agent, such as hollow fine particles or salt, as needed. Consequently, a bubble portion is compressed along with a volume change with respect to various pressure fluctuations, and thus, deformation in directions other than a compression direction is small, making it possible to obtain more stable transferability and durability. As the porous rubber material, there are a material having an open cell structure in which respective pores continue to each other, and a material having a closed cell structure in which the respective pores are independent of each other. Either structure may, however, be used, or both of these structures may be used.

As a member for the elastic layer, the various materials, such as the resin and the ceramic, can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or to maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism that grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source, such as a motor that drives them. A driving force can be delivered by a transmission mechanism, such as a gear mechanism.

Peripheral Unit

The peripheral units 5A to 5D are arranged around the transfer drum 41. In this embodiment, the peripheral units 5A to 5D are specifically an application unit, an absorption unit, a heating unit, and a cleaning unit, in order.

The application unit 5A is a mechanism that applies the reactive liquid onto the transfer member 2 before the print unit 3 discharges ink. The reactive liquid is a liquid that contains a component increasing an ink viscosity. An increase in ink viscosity here means that a coloring material, a resin, and the like, that form the ink react chemically or suck physically by contacting the component that increases the ink viscosity, recognizing the increase in ink viscosity. This increase in ink viscosity includes not only a case in which an increase in viscosity of entire ink is recognized, but also a case in which a local increase in viscosity is generated by coagulating some of components, such as the coloring material and the resin that form the ink.

The component that increases the ink viscosity can use, without particular limitation, a substance, such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like, can be used as a mechanism that applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content, such as a coloring material or a resin included in the ink, with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or less than 10 μm in order to suppress adherence of an ink solid content to the liquid absorbing member. The pore size here refers to an average diameter and can be measured by a known means, such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like, contained in the ink or reactive liquid can be used as the liquid component.

The heating unit 5C is a mechanism that heats the ink image on the transfer member 2 before transfer. A resin in the ink image melts by heating the ink image, improving transferability to the print medium P. A heating temperature can be equal to or greater than the minimum film forming temperature (MFT) of the resin. The MFT can be measured by each apparatus that complies with a generally known method, such as JIS K 6828-2: 2003 or ISO 2115: 1996. From the viewpoint of transferability and image robustness, the ink image may be heated at a temperature greater than the MFT by 10° C. or higher, or may further be heated at a temperature greater than the MFT by 20° C. or higher. The heating unit 5C can use a known heating device, for example, various lamps, such as infrared rays, a warm air fan, or the like. An infrared heater can be used in terms of heating efficiency.

The cleaning unit 5D is a mechanism that cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like, as needed. A known shape, such as a roller shape or a web shape, can be used for a cleaning member used for cleaning.

As described above, in this embodiment, the application unit 5A, the absorption unit 5B, the heating unit 5C, and the cleaning unit 5D are included as the peripheral units. Cooling functions of the transfer member 2 may, however, be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2, such that the temperature of the discharged ink is maintained below the boiling point of water.

The cooling unit may be an air blowing mechanism that blows air to the transfer member 2, or a mechanism that brings a member (for example, a roller) into contact with the transfer member 2 and cools this member by air-cooling or water-cooling. The cooling unit may be a mechanism that cools the cleaning member of the cleaning unit 5D. A cooling timing may be a period before application of the reactive liquid after transfer.

Supply Unit

The supply unit 6 is a mechanism that supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism that deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

Conveyance Apparatus

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit on which the plurality of print media P are stacked and a feeding mechanism that feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism that grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side, but is transferred to the conveyance drums 8*a* from the pressurizing drum 42 after transfer onto the surface. The print medium P is reversed via the two conveyance drums 8*a* and is transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

Post Processing Unit

The conveyance apparatus 1B includes post processing units 10A and 10B. The post processing units 10A and 10B are mechanisms that are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, improving glossiness, and the like, of an image on the image printed surface of the printed product P'. For example, liquid application, sheet welding, lamination, and the like, can be used as an example of coating.

Inspection Unit

The conveyance apparatus 1B includes inspection units 9A and 9B. The inspection units 9A and 9B are mechanisms that are arranged on the downstream side of the transfer unit 4, and inspect the printed product P'.

In this embodiment, the inspection unit 9A is an image capturing apparatus that captures an image printed on the printed product P' and includes an image sensor, for example, a charge coupled device (CCD) sensor, a complementary metal oxide semiconductor (CMOS) sensor, or the like. The inspection unit 9A captures a printed image while a printing operation is performed continuously. Based on the image captured by the inspection unit 9A, it is possible to confirm a temporal change in tint, or the like, of the printed image and to determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images for every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*, that is, stopping conveyance of the printed product P'. The inspection unit 9B may be a scanner that scans the printed product P'.

Control Unit

Figure 4:
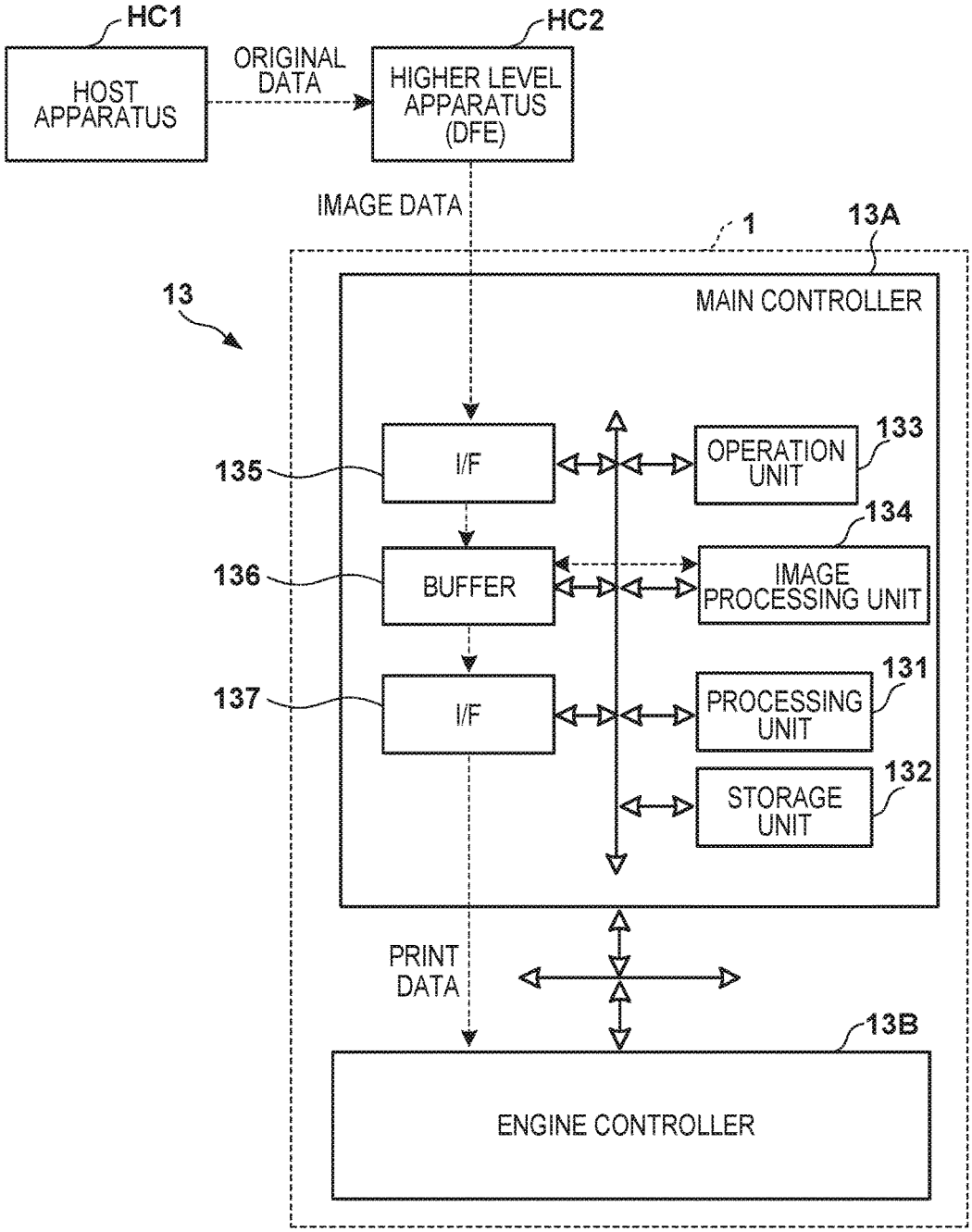
FIG. 4 is a block diagram showing a control system of the printing system in FIG. 1.
Figure 5:
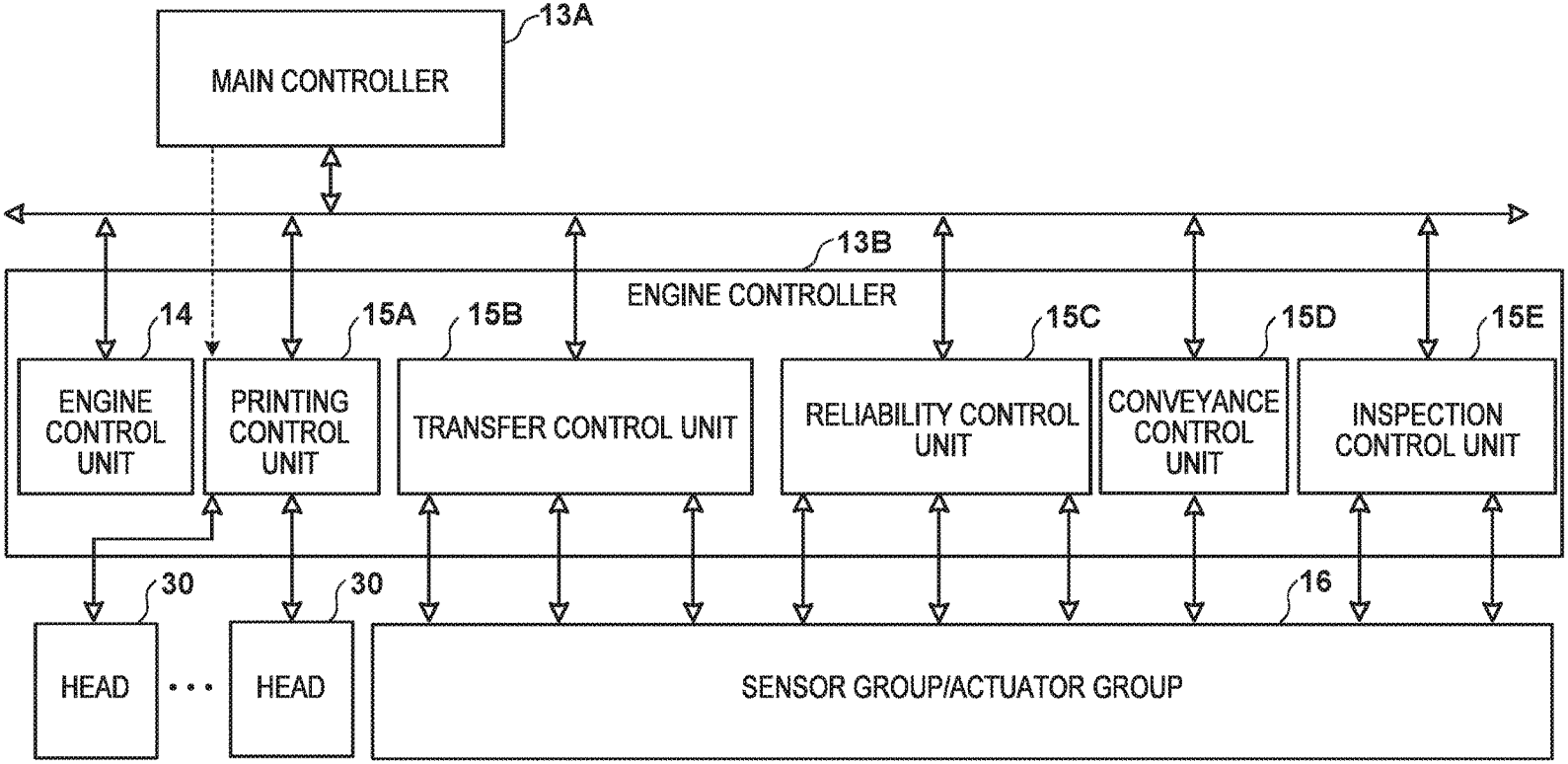
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a personal computer (PC) serving as an information processing apparatus, or a server apparatus. A communication method between the host apparatus HC1 and the higher level apparatus HC2 may be, without particular limitation, either wired or wireless communication.

Original data, to be the source of a printed image, is generated or saved in the host apparatus HC1. The original data here is generated in the format of, for example, an electronic file, such as a document file or an image file. This original data is transmitted to the higher level apparatus HC2. In the higher level apparatus HC2, the received original data is converted into a data format (for example, red green blue (RGB) data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor, such as a central processing unit, executes programs stored in the storage unit 132, and controls the entire main controller 13A. The storage unit 132 is a storage device, such as a random access memory (RAM), a read only memory (ROM), a hard disk, or a solid state drive (SSD), stores data and the programs executed by the processing unit 131, and provides the processing unit (CPU) 131 with a work area. An external storage unit may further be provided in addition to the storage unit 132. The operation unit 133 is, for example, an input device, such as a touch panel, a keyboard, or a mouse, and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication interface (I/F) 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data, after the image processing and being stored in the buffer 136, is transmitted from the communication I/F 137 to the engine controller 13B as print data used by a print engine.

As shown in FIG. 5, the engine controller 13B includes engine control units 14 and 15A to 15E, obtains a detection result of a sensor group/actuator group 16 of the printing system 1, and controls driving of the groups. Each of these control units includes a processor, such as a CPU, a storage device, such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data, or the like, in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism that moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
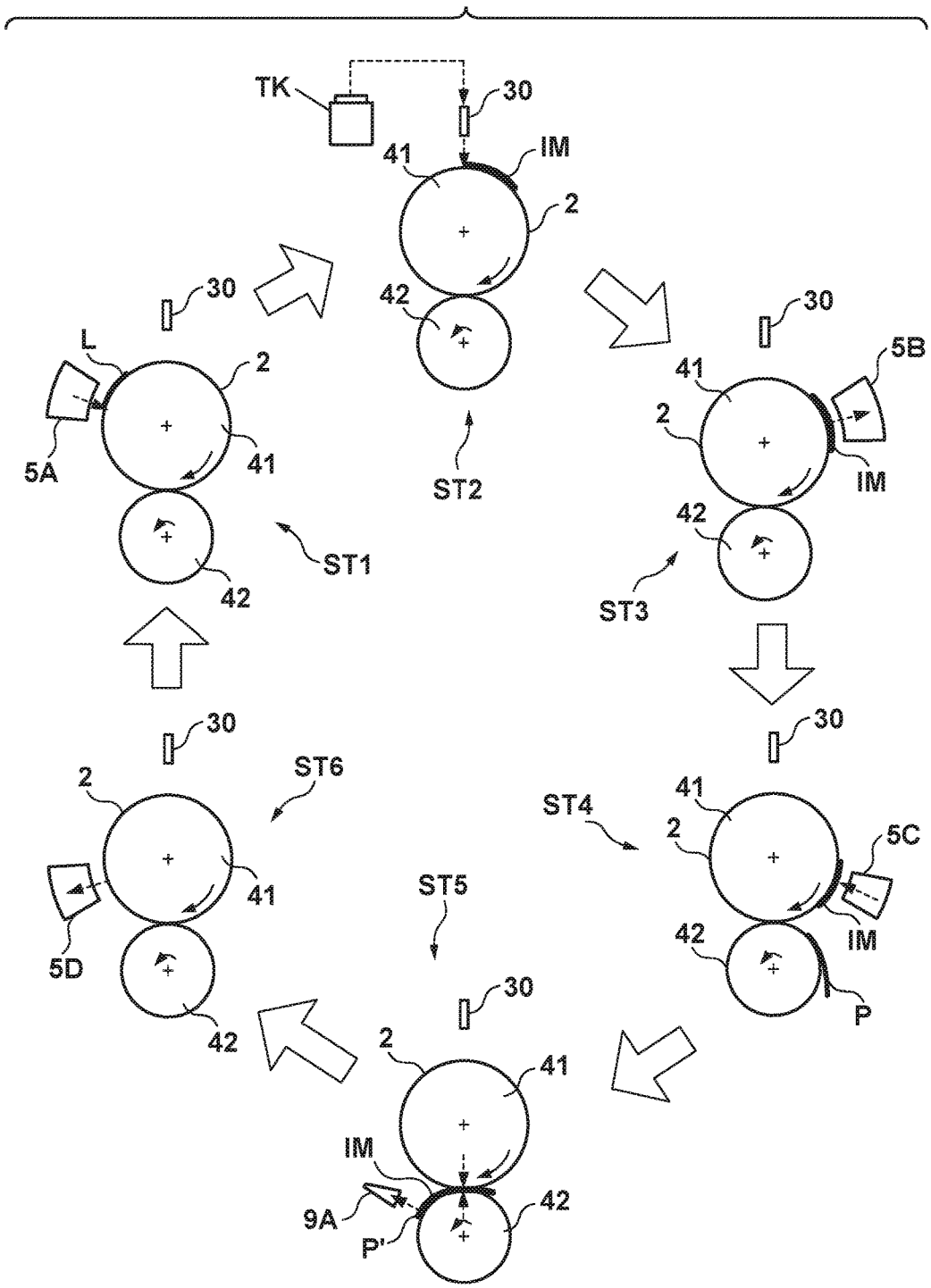
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion, on which the ink image IM on the transfer member 2 is formed, reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
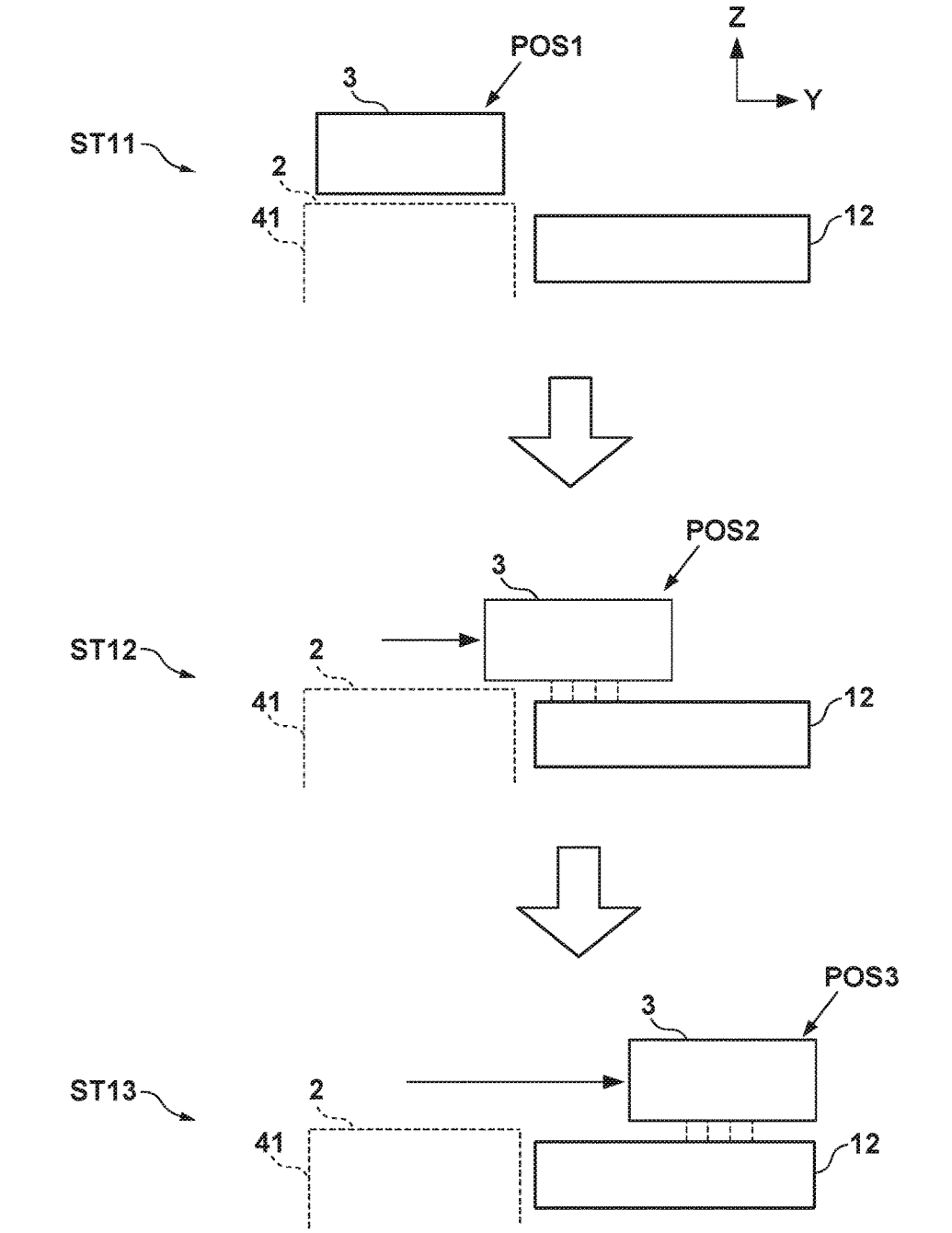
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

A method of inspecting the quality of an image formed on the print medium P in the printing system having the above arrangement will be described next. This inspection is performed at the time of printhead exchange, at the time of a periodic inspection of the printing system, at any desired time set by a user, or the like.

Detailed Description of Inspection Unit 9B

Figure 8:
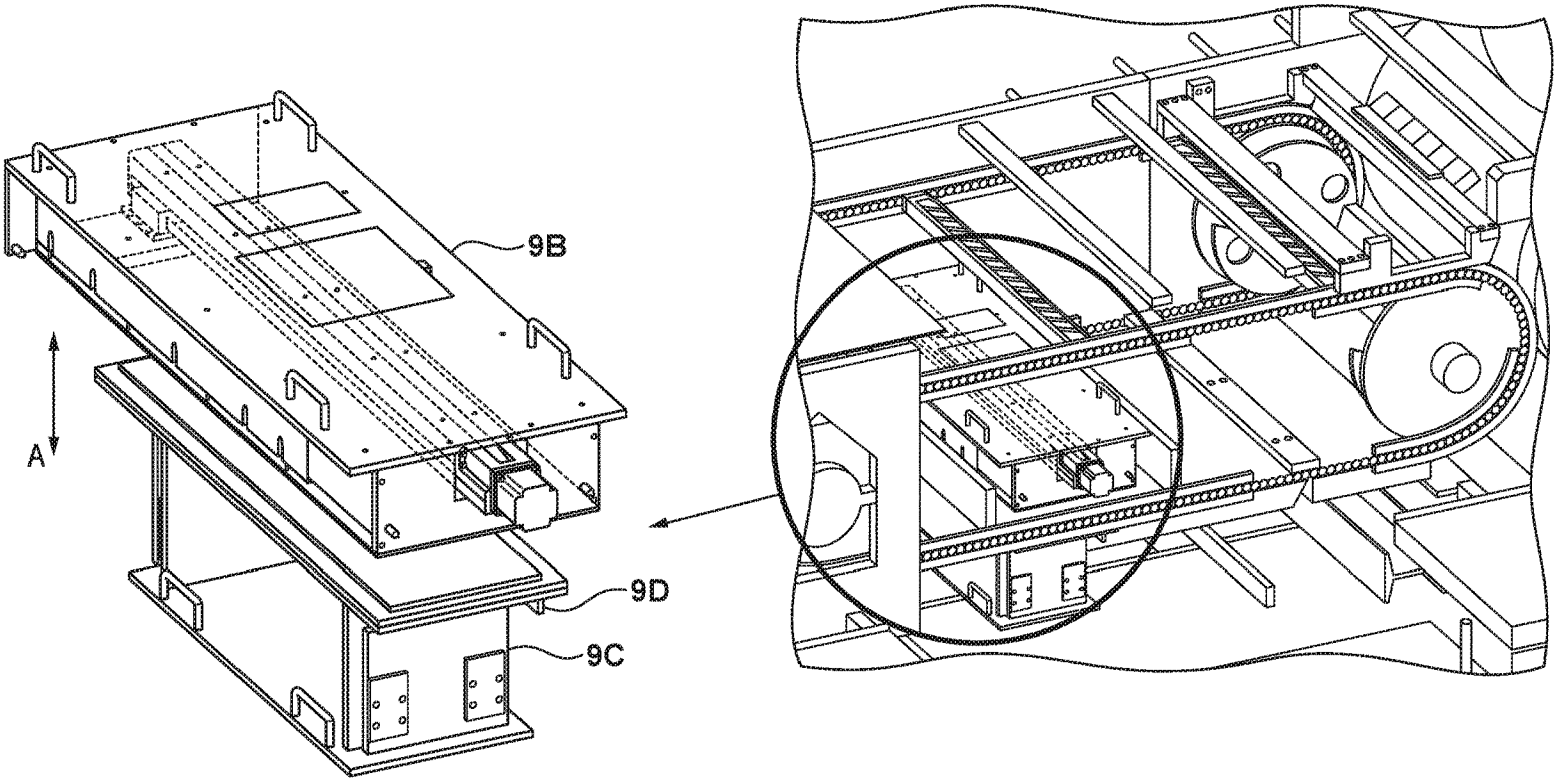
FIG. 8 shows views of the outer appearance of the arrangement of an inspection unit shown in FIG. 1.

FIG. 8 shows views each showing the outer appearance of the arrangement of the inspection unit 9B shown in FIG. 1. A perspective view of a portion in which the inspection unit 9B shown in FIG. 1 is provided is shown on the right side of FIG. 8. An enlarged perspective view of the arrangement of a region surrounded by an ellipse in the right-side view is shown on the left side of FIG. 8.

The inspection unit 9B in this embodiment is a scanner that optically reads an image. A lift-up unit 9C is provided so as to face the scanner across a conveyance path of the print medium P. In this embodiment, this scanner has an 850-mm reading width to be able to read an A0-size print medium in a longitudinal direction. In addition, this scanner includes a reading area capable of reading an image at once with an A4 width (210 mm) in a conveyance direction of the print medium P if the print medium P stands still. Accordingly, this scanner includes a reading area capable of reading an image of 850-mm width×210-mm length at once. An elevating unit 9D on the lift-up unit 9C can move in the directions of an arrow A that are perpendicular to the conveyance direction of the print medium P and press the print medium P against the scanner. A white board, included on the upper surface of the elevating unit 9D, is 850-mm width×210-mm length in correspondence with the size of the reading area of the scanner, and can press the print medium P over the entire reading area by the scanner.

Figure 9:
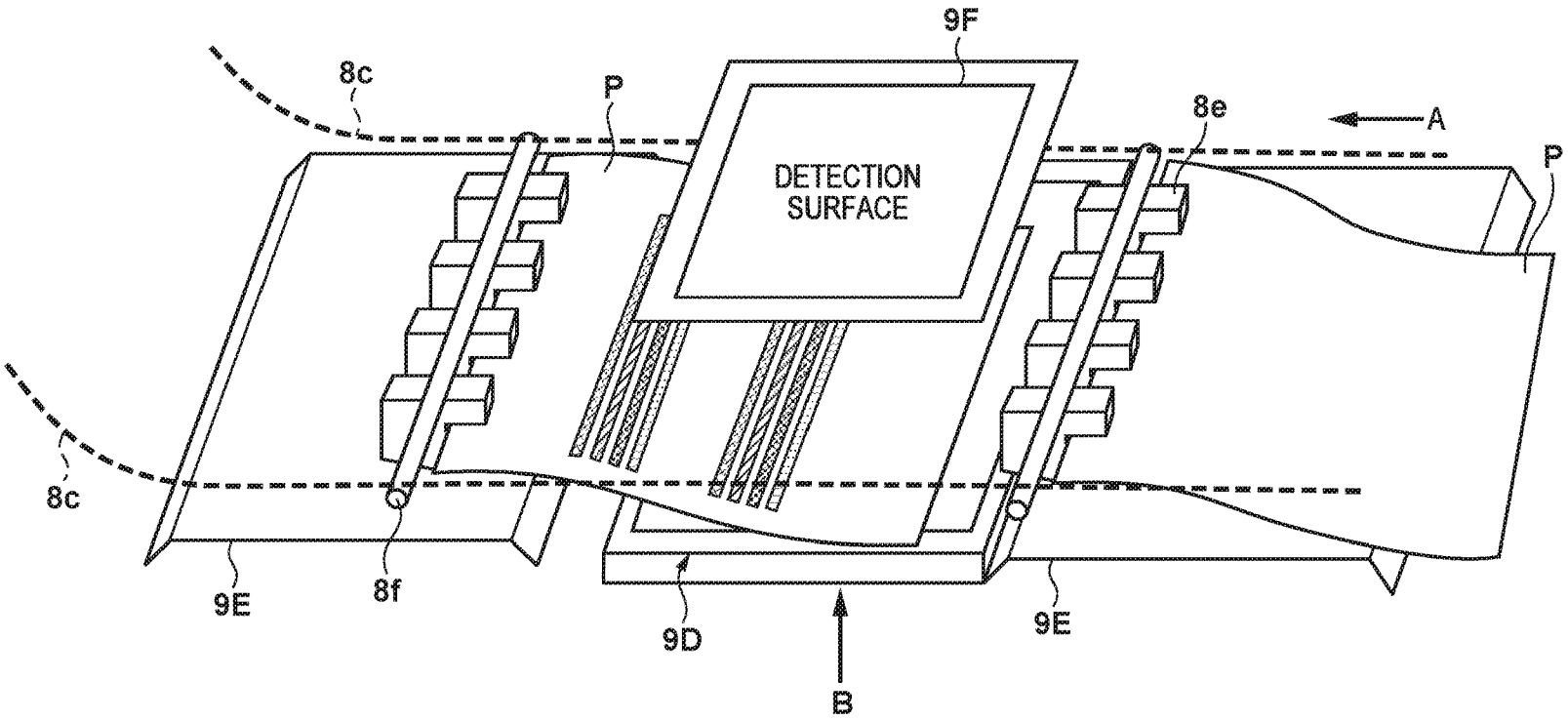
FIG. 9 is a perspective view showing a state in which print media pass through an image reading area of the inspection unit.

FIG. 9 is a perspective view showing a state in which the print media pass through an image reading area of the inspection unit.

In an example shown in FIG. 9, a state is shown in which the plurality of print media P, onto which images are transferred and which are gripped by grip mechanisms 8*e*, are conveyed continuously in a direction from the right to the left as indicated by the arrow A. In this example, the preceding print medium P reaches between a detection surface 9F of the inspection unit 9B and the elevating unit 9D of the lift-up unit 9C, and the succeeding print medium P reaches a conveyance guide 9E on the right side. Each of these grip mechanisms 8*e* is fixed to a chain clipper 8*f*, and the chain clipper 8*f* engages with the chain 8*c*. The print media P are thus conveyed in the direction of the arrow A along with the circulation of the chain 8*c*.

Then, the elevating unit 9D can move in a direction of an arrow B perpendicular to the arrow A. This makes it possible to press the print medium P that reaches between the detection surface 9F and the elevating unit 9D against the detection surface 9F.

The quality of the images printed by the printing system is inspected by performing image processing for stopping conveyance of the print medium P, further pressing and fixing the print medium P, and causing the scanner to read the images at a predetermined interval in the conveyance direction of the print medium. The inspection of a printed product printed on the print medium P is thus performed.

Figure 10:
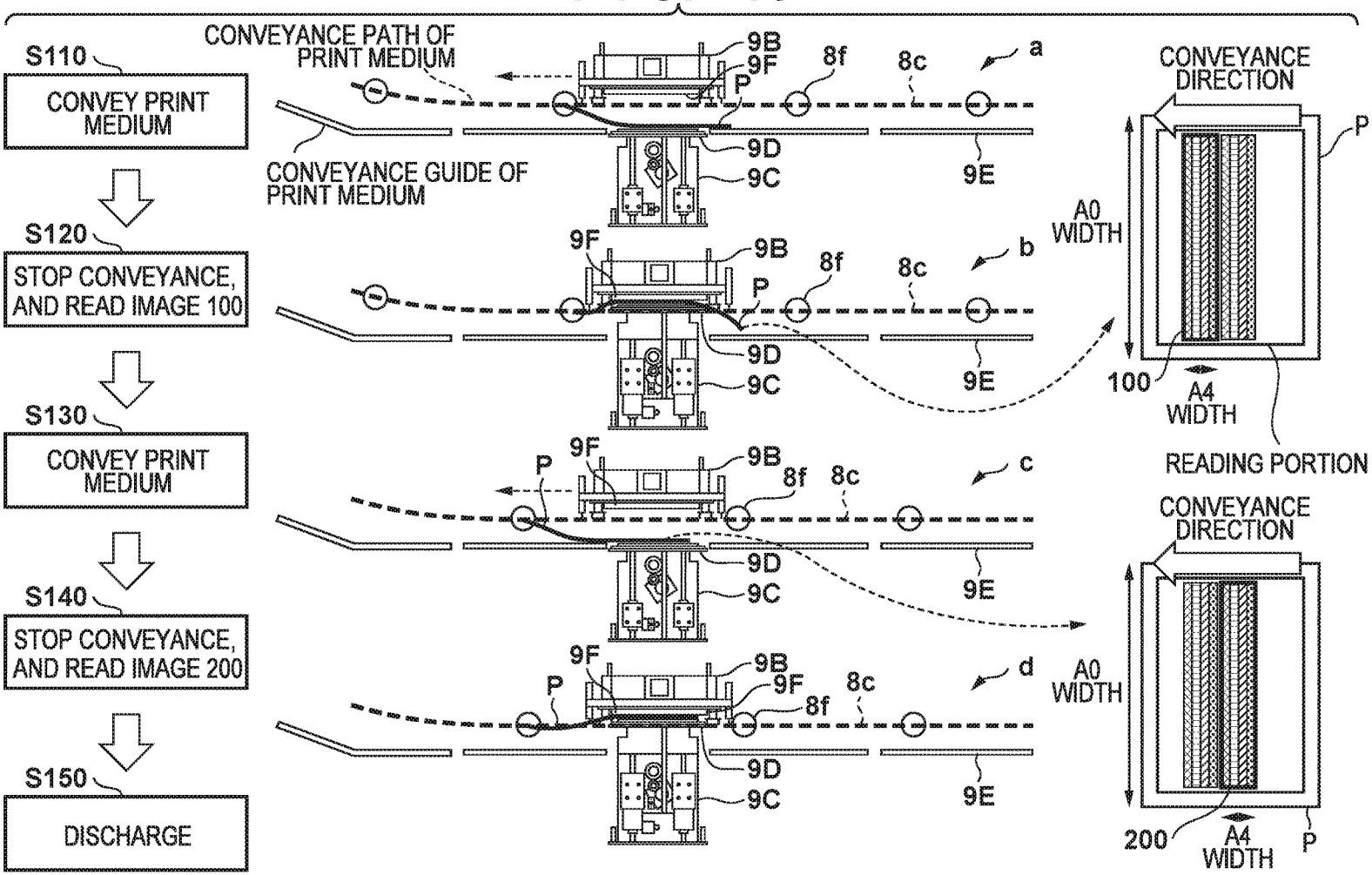
FIG. 10 shows views and a flowchart of a state in which images are read by causing the print medium to pass through the image reading area of the inspection unit.

FIG. 10 shows views and a flowchart of a state in which images are read by causing the print medium to pass through the image reading area of the inspection unit.

FIG. 10 shows the views in which the inspection unit 9B and the lift-up unit 9C are viewed in a direction perpendicular to the arrow A indicating the conveyance direction of the print media and the arrow B indicating the moving direction of the elevating unit 9D in FIG. 9 (a direction perpendicular to a sheet surface).

According to FIG. 10, as shown in a, in step S110, the print medium P gripped by the grip mechanisms 8*e* is conveyed immediately below the scanner 9B by rotating the chain 8*c* engaged with the chain clippers 8*f*. At this time, the elevating unit 9D of the lift-up unit 9C is at a position (first position) retracted from the conveyance path of the print medium so as not to impede conveyance of the print medium P.

Next, as shown in b, in step S120, conveyance of the print medium P is stopped when an image 100 that is printed on the print medium P shown on the right side of FIG. 10 reaches the reading area of the scanner 9B. Then, the elevating unit 9D of the lift-up unit 9C is moved upward (second position) to press/fix the print medium P against/to the detection surface 9F of the scanner 9B, reading the area of the image 100 by the scanner 9B. In this reading process, an image of 850-mm width×210-mm length corresponding to the swath image 100 is read once.

When reading is complete, as shown in c, in step S130, the elevating unit 9D of the lift-up unit 9C is moved downward (first position) again. Then, conveyance of the print medium P gripped by the grip mechanisms 8*e* is resumed until an image 200 printed on the print medium P reaches the reading area of the scanner 9B by rotating the chain 8*c* engaged with the chain clippers 8*f*.

Subsequently, as shown in d, in step S140, the elevating unit 9D of the lift-up unit 9C is moved upward (second position) again to press/fix the print medium P against/to the detection surface 9F of the scanner 9B, reading the area of the image 200 by the scanner 9B. In this reading process, an image of 850-mm width×210-mm length corresponding to the swath image 200 is read at once.

Subsequently, in step S150, the elevating unit 9D of the lift-up unit 9C is moved downward (first position) to discharge the print medium P from the inspection unit 9B.

Figure 11:
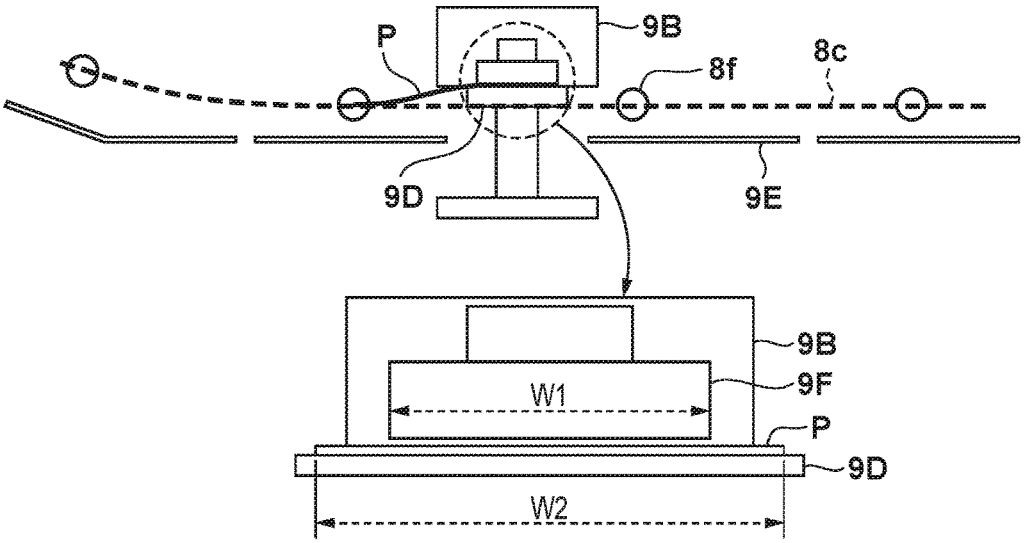
FIG. 11 is a view showing a relationship among a detection surface, the print medium, and the size of an elevating unit concerning a conveyance direction of the print medium when the print medium is pressed.

FIG. 11 is a view showing a relationship among the detection surface, the print medium P, and the size of the elevating unit concerning the conveyance direction of the print medium when the print medium P is pressed.

As can be seen in FIG. 11, a size W2 of the elevating unit 9D used to press the print medium P and fix the print medium P is greater in length than a size W1 of the detection surface 9F of the scanner 9B (W2>W1) with respect to the conveyance direction of the print medium P. This fixes the print medium P reliably so as not to cause an image reading deviation when the inspection unit reads the swath images.

Note that in the above arrangement, the elevating unit 9D of the lift-up unit 9C is configured to move upward/downward in order to press the print medium P. An arrangement may be possible, however, in which the detection surface 9F of the scanner 9B is moved to press the print medium P.

Therefore, according to the above-described embodiment, it is possible to stop conveyance of a print medium P when an image printed on the print medium P is read, to press/fix the print medium P against/to a detection surface of a scanner, and to release the pressing when image reading is complete. This makes it possible, also in a case in which the image printed on the print medium P is read, and an inspection of a printed product is performed, to perform the inspection without scratching a medium to be inspected. Moreover, the entire image reading area on the print medium P is pressed when image reading is performed, making it possible to reliably perform the image reading without the print medium deviation and to perform the inspection accurately.

Note that in the above-described embodiment, as shown in FIG. 10, the elevating unit 9D is configured to move between the first position retracted from the conveyance path of the print medium P and the second position in which the print medium P is pressed, and to stop at these two positions. The present invention is not, however, limited to this configuration. For example, the elevating unit 9D may be configured to also stop at the third position between the first position and the second position, which is retracted from the conveyance path of the print medium, but at which the print medium P is not pressed.

Figure 12:
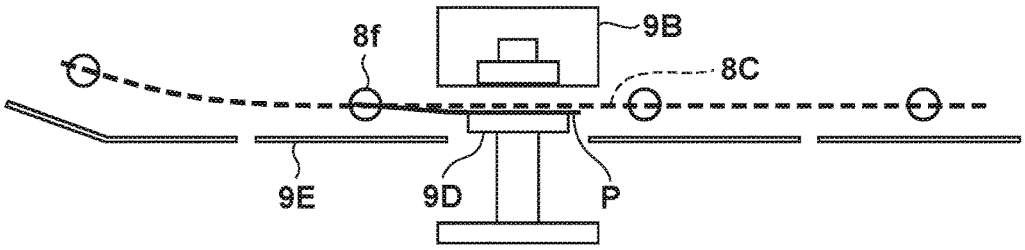
FIG. 12 is a view showing a state in which the elevating unit stops at the third position.

FIG. 12 is a view showing a state in which the elevating unit 9D stops at the third position. By thus configuring the elevating unit 9D, it is possible to control the elevating unit 9D to stop at the third position if the print medium P moves from the reading position of one portion of an image to the reading position of another portion of the image when the image printed on the print medium P is read at a plurality of positions. Consequently, the moving distance of the elevating unit 9D becomes shorter than in the arrangement shown in FIG. 10, making it possible to perform a plurality of image reading operations in a shorter amount of time.

Another Embodiment

Figure 13A:
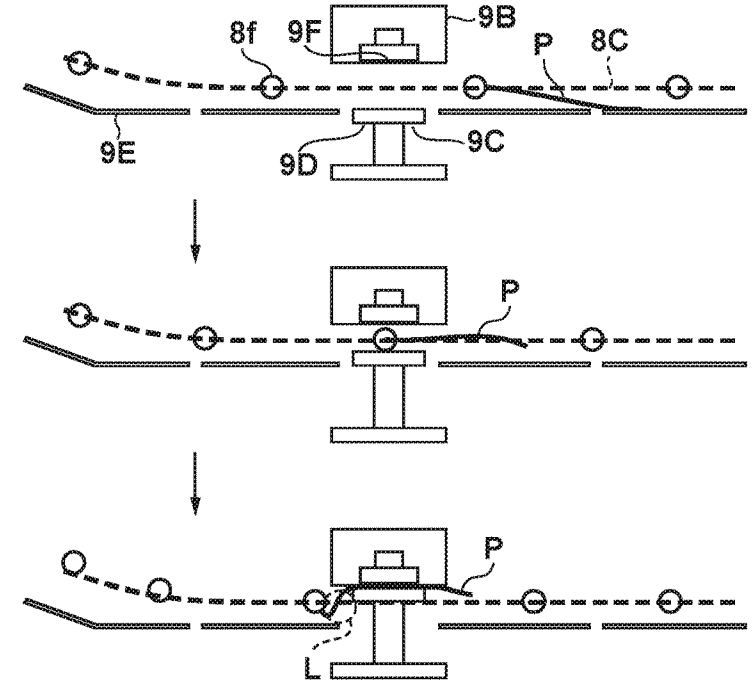
FIGS. 13A and 13B are views each showing a state in which an image is read by causing a print medium to pass through an image reading area of an inspection unit according to another embodiment.
Figure 13B:
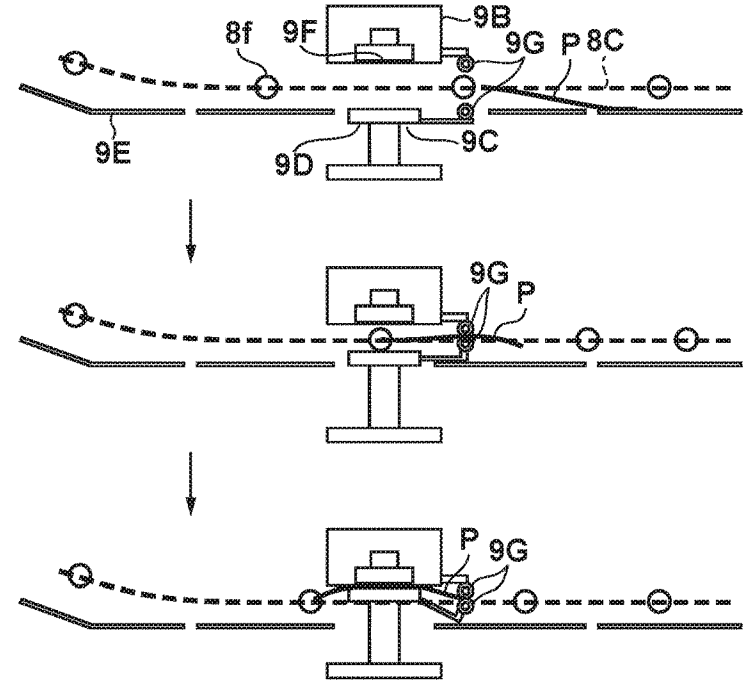

FIGS. 13A and 13B are views each showing a state in which an image is read by causing a print medium P to pass through an image reading area of an inspection unit according to another embodiment.

FIG. 13A shows a state in which the image is read by causing the print medium P to pass through the image reading area of the inspection unit with the arrangement in the aforementioned embodiment. FIG. 13B shows a state in which the image is read by causing the print medium P to pass through the image reading area of the inspection unit according to the other embodiment.

Both of FIGS. 13A and 13B show a state in which a print medium P is conveyed from the right to the left and passes through the inspection unit.

According to FIG. 13A, while the leading edge portion of the print medium P that has passed through a scanner 9B is pulled by a chain clippers 8*f*, the trailing edge portion of the print medium P becomes free and does not receive any regulation, resulting in a portion indicated by a broken-line circle L slacking. The print medium P (image) may be scratched by such a slack when the scanner reads the image.

To cope with this, according to FIG. 13B, a pair of pinch rollers 9G are provided on the upstream side of the scanner 9B in a conveyance direction of the print medium. By providing such an arrangement, the trailing edge portion of the print medium P is pinched by the pair of pinch rollers 9G even if the leading edge portion of the print medium P that has passed through the scanner 9B is pulled by the chain clippers 8*f*, as shown in FIG. 13B.

Therefore, according to the above-described embodiment, the trailing edge portion of the print medium P is pinched on the upstream side of the scanner in the conveyance direction, and thus, the print medium P is neither slacked nor scratched even if the print medium P is pressed/fixed against/to the scanner.

In the above embodiment, the print unit 3 includes the plurality of printheads 30. A print unit 3 may, however, include one printhead 30. The printhead 30 may not be a full-line head, and may be of a serial type that forms an ink image while scanning the printhead 30 in a Y direction.

A conveyance mechanism of the print medium P may adopt another method, such as a method of clipping and conveying the print medium P by the pair of rollers. In the method of conveying the print medium P by the pair of rollers, or the like, a roll sheet may be used as the print medium P, and a printed product P' may be formed by cutting the roll sheet after transfer.

In the above embodiment, the transfer member 2 is provided on the outer peripheral surface of the transfer drum 41. Another method, such as a method of forming a transfer member 2 into an endless swath and running it cyclically, may, however, be used.

Embodiments of the present invention can also be realized by a computer of a system or an apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™) a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing apparatus comprising:

a printhead configured to discharge ink to a transfer member to form an image;

a transfer unit configured to transfer the image from the transfer member to a print medium;

a conveyance unit configured to convey the print medium to which the image has been transferred by the transfer unit;

a reading unit having a detection surface, and being configured to read the image on the print medium conveyed by the conveyance unit;

a fixing unit configured to fix a relative position between the detection surface and the print medium in one of a first state, in which the detection surface is in contact with the print medium, and a second state, in which the detection surface is not in contact with the print medium; and a control unit configured to control operation so as to stop conveyance by the conveyance unit and to fix the relative position between the detection surface and the print medium to the first state, using the fixing unit, in a case in which the reading unit reads the image, and to change the relative position between the detection surface and the print medium from the first state to the second state, using the fixing unit, and to resume conveyance by the conveyance unit after the image reading by the reading unit is complete.

2. The apparatus according to claim 1, wherein the fixing unit includes a pressing unit provided so as to face a reading area of the reading unit across a conveyance path of the print medium by the conveyance unit and configured to press the print medium.

3. The apparatus according to claim 2, wherein the pressing unit includes an elevating unit configured to move between a first position retracted from the conveyance path of the print medium by the conveyance unit and a second position in which the print medium is pressed.

4. The apparatus according to claim 3, wherein the elevating unit can move to and stop at a third position, which is between the first position and the second position, which is retracted from the conveyance path of the print medium, and at which the print medium is not pressed.

5. The apparatus according to claim 4, wherein in a case in which the reading unit reads the image printed on the print medium at a plurality of positions, the control unit controls the elevating unit to move between the second position and the third position until image reading at the plurality of positions is complete.

6. The apparatus according to claim 2, wherein an area at which the pressing unit presses the print medium is greater than the reading area of the reading unit.

7. The apparatus according to claim 1, wherein the conveyance unit includes:

a grip mechanism configured to grip a leading edge portion of the print medium from a downstream side with respect to a conveyance direction of the print medium; and a chain configured to move the grip mechanism in the conveyance direction.

8. The apparatus according to claim 1, further comprising a pinch roller provided on an upstream side of the reading unit and configured to clip the print medium with respect to a conveyance direction of the print medium.

9. The apparatus according to claim 1, wherein the reading unit comprises a scanner configured to read an image optically.

10. The apparatus according to claim 1, wherein the conveyance unit conveys the print medium to a reading position to be read by the reading unit, and then discharges the print medium.

11. An inspection apparatus that reads an image printed on a print medium and inspects the image, the apparatus comprising:

a conveyance unit configured to convey the print medium;

a reading unit having a detection surface, and being configured to read the image on the print medium conveyed by the conveyance unit;

a fixing unit configured to fix a relative position between the detection surface and the print medium to one of a first state, in which the detection surface is in contact with the print medium, and a second state, in which the detection surface is not in contact with the print medium; and a control unit configured to control operation so as to stop conveyance by the conveyance unit and to fix the relative position between the detection surface and the print medium to the first state, using the fixing unit in a case in which the reading unit reads the image, and to change the relative position between the detection surface and the print medium from the first state to the second state using the fixing unit and to resume conveyance by the conveyance unit after the image reading by the reading unit is complete.

12. The apparatus according to claim 11, wherein the fixing unit includes a pressing unit provided so as to face a reading area of the reading unit across a conveyance path of the print medium by the conveyance unit and configured to press the print medium.

13. The apparatus according to claim 12, wherein the pressing unit includes an elevating unit configured to move between a first position retracted from the conveyance path of the print medium by the conveyance unit and a second position in which the print medium is pressed.

14. The apparatus according to claim 13, wherein the elevating unit can move to and stop at a third position, which is between the first position and the second position, which is retracted from the conveyance path of the print medium, and at which the print medium is not pressed.

15. The apparatus according to claim 14, wherein in a case in which the reading unit reads the image printed on the print medium at a plurality of positions, the control unit controls the elevating unit to move between the second position and the third position until image reading at the plurality of positions is complete.

16. The apparatus according to claim 12, wherein an area at which the pressing unit presses the print medium is greater than the reading area of the reading unit.

17. The apparatus according to claim 11, wherein the conveyance unit includes:

a grip mechanism configured to grip a leading edge portion of the print medium from a downstream side with respect to a conveyance direction of the print medium; and a chain configured to move the grip mechanism in the conveyance direction.

18. The apparatus according to claim 11, further comprising:

a pinch roller provided on an upstream side of the reading unit and configured to pinch the print medium with respect to a conveyance direction of the print medium; and a print unit configured to print an image on the print medium, the print unit including:

(i) a printhead configured to discharge ink;

(ii) a transfer member on which an image is formed by the ink discharged from the printhead; and (iii) a transfer unit configured to transfer the image from the transfer member to the print medium, wherein the reading unit comprises a scanner configured to read an image optically, and the conveyance unit conveys the print medium to which the image has been transferred by the transfer unit.

19. The apparatus according to claim 18, wherein the conveyance unit conveys the print medium to a reading position to be read by the reading unit, and then discharges the print medium.

20. A method of controlling an inspection apparatus that reads an image printed on a print medium and inspects the image, the method comprising:

reading, by a reading unit having a detection surface, the image on the print medium conveyed by a conveyance unit;

fixing, by a fixing unit, a relative position between the detection surface and the print medium to one of a first state, in which the detection surface is in contact with the print medium, and a second state, in which the detection surface is not in contact with the print medium; and controlling operation so as to stop conveyance by the conveyance unit and to fix the relative position between the detection surface and the print medium to the first state, using the fixing unit in a case in which the reading unit reads the image, and to change the relative position between the detection surface and the print medium from the first state to the second state, using the fixing unit, and to resume conveyance by the conveyance unit after the image reading by the reading unit is complete.

* * * * *